US005235930A

United States Patent [19]

Pendleton

[11] Patent Number: 5,235,930

[45] Date of Patent: Aug. 17, 1993

[54] SELF PROPELLED UNDERWATER DEVICE WITH STEERABLE FIN STABILIZER

[75] Inventor: Ronald C. Pendleton, Santa Ana, Calif.

[73] Assignee: Rockwell International Corporation, Seal Beach, Calif.

[21] Appl. No.: 880,398

[22] Filed: May 8, 1992

[51] Int. Cl.[5] ..... B63G 8/00

[52] U.S. Cl. ..... 114/312; 114/330; 114/337

[58] Field of Search ..... 114/333, 312, 313, 264, 114/265, 266, 330, 337, 126

[56] References Cited

U.S. PATENT DOCUMENTS

| | | | |
|---|---|---|---|
| 3,878,803 | 4/1975 | Leverton | 114/267 |
| 4,187,796 | 2/1980 | Ess | 114/312 |
| 4,218,985 | 8/1980 | Jones, Jr. . | |
| 4,323,208 | 4/1982 | Ball . | |
| 4,411,398 | 10/1983 | Wedertz et al. . | |
| 4,664,339 | 5/1987 | Crossfield . | |
| 4,667,899 | 5/1987 | Wedertz . | |
| 4,709,877 | 12/1987 | Goulding . | |
| 4,869,442 | 9/1989 | Miller . | |

*Primary Examiner*—Joseph F. Peters, Jr.

*Assistant Examiner*—Stephen P. Avila

*Attorney, Agent, or Firm*—H. Fredrick Hamann; George A. Montanye; Wilfred G. Caldwell

[57] ABSTRACT

The invention is a Self Propelled Underwater Device With Steerable Fin Stabilizer having a unique hull of generally tubular configuration and having a substantially conical shaped rear portion. The hull comprises a plurality of hollow interlocking tubular sections with one section including the rear portion; adjacent tubular hull sections include peripherally spaced apart threaded portions respectively disposed internally and externally thereof for mating relationship upon relative circumferential motion of the adjacent sections, the adjacent sections are further configured to provide an abutting joint when fully mated with watertight sealing means between the mated sections. The vehicle includes a plurality of steerable stabilization fins mounted on the hull about the rear conical portion at spaced apart locations with hull slots for receiving the respective fins when stowed. Common means pivot the fins out of said slots to extend generally perpendicular from said hull, and rotate each fin to steer the vehicle. Also, there is provided means for controlling the rotating means and a motor for driving a rear propeller.

44 Claims, 13 Drawing Sheets

SELF PROPELLED UNDERWATER DEVICE WITH STEERABLE FIN STABILIZER

BACKGROUND OF THE INVENTION

1. Field of the Invention

The present invention relates to underwater vehicles, and more particularly, to self-deploying, steerable, guidance and stabilization fin equipped underwater vehicles including torpedoes and torpedo type underwater devices. The invention further relates to an apparatus for providing dynamic control over underwater vehicle direction or trajectory, and stabilization.

2. Related Technical Art

The use of fins for stabilizing the passage of small vehicles through a fluid medium, such as water is well known. Fins provide some degree of directional and pitch stability, as well as resistance to roll forces created by forward thrust generators, such as propellers. However, it is generally desirable to provide minimum vehicle drag and turbulence since these factors impact both energy or fuel consumption, and stealth or detection where applicable. For this reason, vehicle or projectile shapes are generally very rounded with tapered tail or end sections in order to minimize drag and turbulence. At the same time, stabilization fins are generally made very small, in terms of projection from the vehicle, and are secured along the tapered portion.

SUMMARY

In view of limitations found in the current art, it is one purpose of the present invention to provide a self-deploying, stowable, stabilization fin controlled small underwater vehicle.

A further feature of the invention is a combination watertight tubular hull of interlocking sections accommodating the steerable stabilization fins, suitable for high speed running or for towing cable arrays, for example.

An advantage of the present invention is that the directional control provides a highly maneuverable vehicle.

Another advantage is that the stabilization and control are provided with a minimum cost in volume or power.

These and other purposes, objects, and advantages are realized in a steerable stabilization fin assembly for integral use with underwater vehicles which uses a fin having a predetermined desirable configuration with a mounting tab formed along the root edge extending between leading and trailing edges. By way of example, a fin may protrude from the hull a distance of less than one sixth the length of the hull and still achieve all necessary functioning.

A support yoke is secured to the vehicle adjacent to an outer surface so that it is freely rotatable about a fixed central axis which extends substantially perpendicular to the outer surface. A rotation element connected between the support yoke and the mounting tab joins the fin to the support yoke and allows rotation of the tab, and, thus, the fin, about a second axis which extends substantially perpendicular to the first fixed axis. A deployment element is connected between the yoke and the fin for rotating the fin about the second axis in order to move the fin between a stowed position and an erected position extending outward from the outer surface.

In a preferred embodiment, the support yoke is constructed with a main body having a channel extending inward from one side of the main body starting with an open end adjacent to the body side and terminating with a closed end. The channel is made sufficiently wide enough for insertion of the fin support tab. The tab comprises a projection with a curved edge extending outward from the fin root edge and has two opposing, generally parallel, planar surfaces, and a centrally located axial passage extending between the two planar surfaces. The tab is preferably located adjacent to the leading edge of the fin.

The yoke channel has cylindrical passages or depressions in the sidewalls which are aligned with the passage in the mounting tab. The rotation element comprises a cylindrical pin extending through the mounting tab axial passage and into the matching cylindrical passages in the yoke channel sidewalls. The deployment element comprises a coiled spring assembly secured about the cylindrical pin, and typically has one or more bent end sections for engaging the fin on one end and the yoke on the other.

In embodiments desiring improved alignment and fin support, the closed end and the bottom of the channel are beveled or curved surfaces or depressions with the curved edge of the mounting tab having a matching beveled or rounded surface. That is, the mounting tab has a bevel angle or arch substantially the same as the channel front and bottom walls. This provides for precision alignment and surface engagement in the presence of transverse forces. The yoke is provided with a support post formed on a lower portion of the main body and extending along the fixed axis into the vehicle housing. The support post acts as a pivot element for selectively rotating the yoke about the fixed axis. The support post is generally connected to one or more actuation means such as levers or gears within the vehicle for application of rotary power and control.

A retention element is useful in securing the fin in a stowed position. A useful retention element is a leaf spring for engaging a depression along the mounting tab curved edge. Likewise, a similar element can be employed for securing a deployed fin in place. Preferably, a stainless steel band encircles the hull and fins and is secured by an explosive bolt, which is exploded by a time delayed signal from the computer after the ON button is pushed.

The invention, when serving as an underwater device, preferably has a lightweight but exceedingly strong aluminum body, assembled as interrupted thread and O-ring interlocking cylindrical segments in a unique skin loaded watertight tubular configuration which readily facilitates maintenance. One segment includes the energy source, usually a plurality of individual interconnected batteries, while further sections include the direct current motor, the computer for generating control signals, such as fin right or left signals and a further section including the fin actuator mechanisms.

Preferably, several programs are stored in the computer or on tape in a tape reader to selectively predetermine the course of the underwater vehicle by controlling the fins, motor speed, and depth.

A hollow drive shaft extends from the motor to a propeller hub on the rear end, and an array cable extends through the hollow drive shaft to connect within the hull for towing.

BRIEF DESCRIPTION OF THE DRAWINGS

The novel features of the present invention may be better understood from the accompanying description when taken in conjunction with the accompanying drawings in which.

DETAILED DESCRIPTION OF PREFERRED EMBODIMENTS

The present invention provides a new capability to provide a stowable, self-deploying, steerable, stabilization fin equipped underwater vehicle, such as a torpedo or torpedo type underwater towing device. The invention provides a stabilization fin having a rotatable mounting tab extending from one edge adjacent to the leading edge. The mounting tab fits within a support yoke and is secured in place using an axle pin about which it rotates. The support yoke in turn is secured to a rotary mounting within a housing for the underwater vehicle. An extension of the yoke base is connected to a rotary motion actuator for altering the attitude of the fin through yoke movement. A deployment spring mounted around the fin axle presses against the fin and yoke structures and forces the fin outward from the vehicle housing to a deployed position. A retention spring for stowed or deployed position security can also be used, but preferably, for insuring stowed position, stainless steel strap 11 (FIG. 1*e*) tightly encircles all four fins 13, 15, and 16, 17 and is secured by explosive bolt-charge 19, or equivalent structure.

Figure 1E:
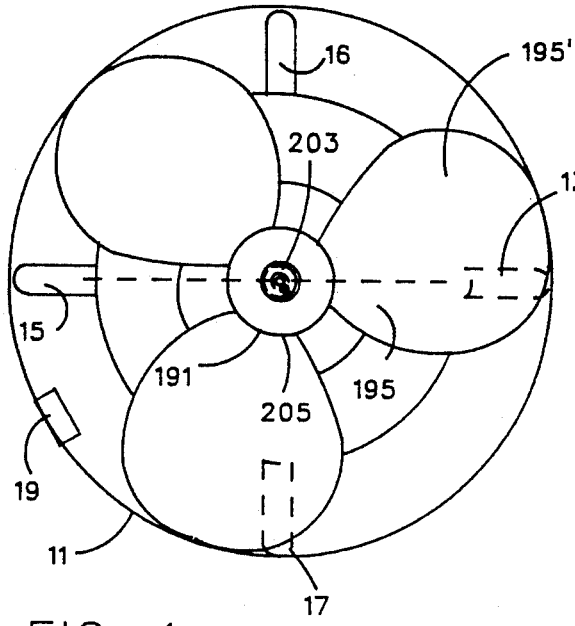
FIG. 1*e* is a rear view of the tail section of the device, with all fins in retracted position.
Figure 1:
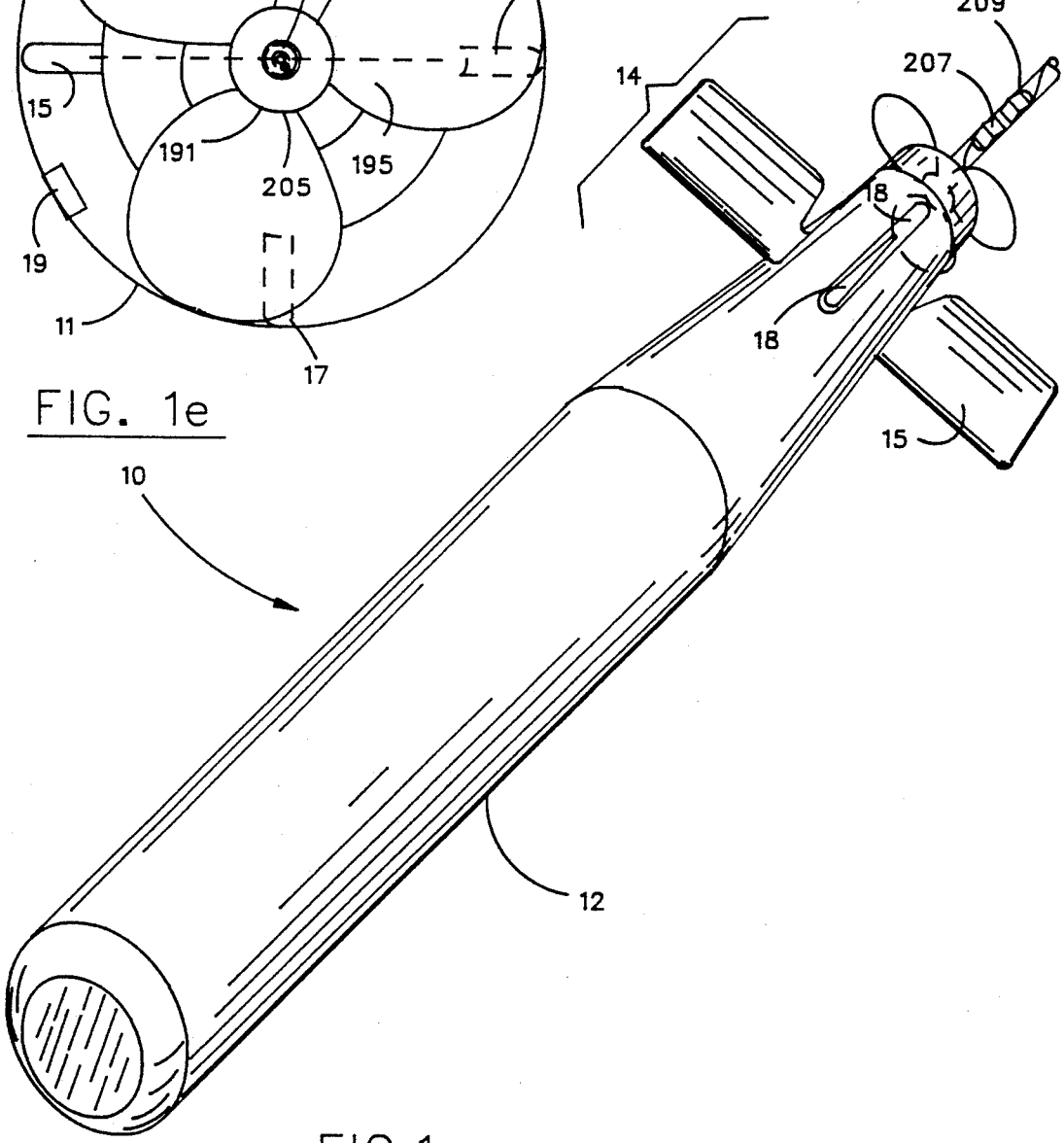
FIG. 1 is a perspective view of the underwater vehicle with fins deployed in operative position.
Figure 1A:
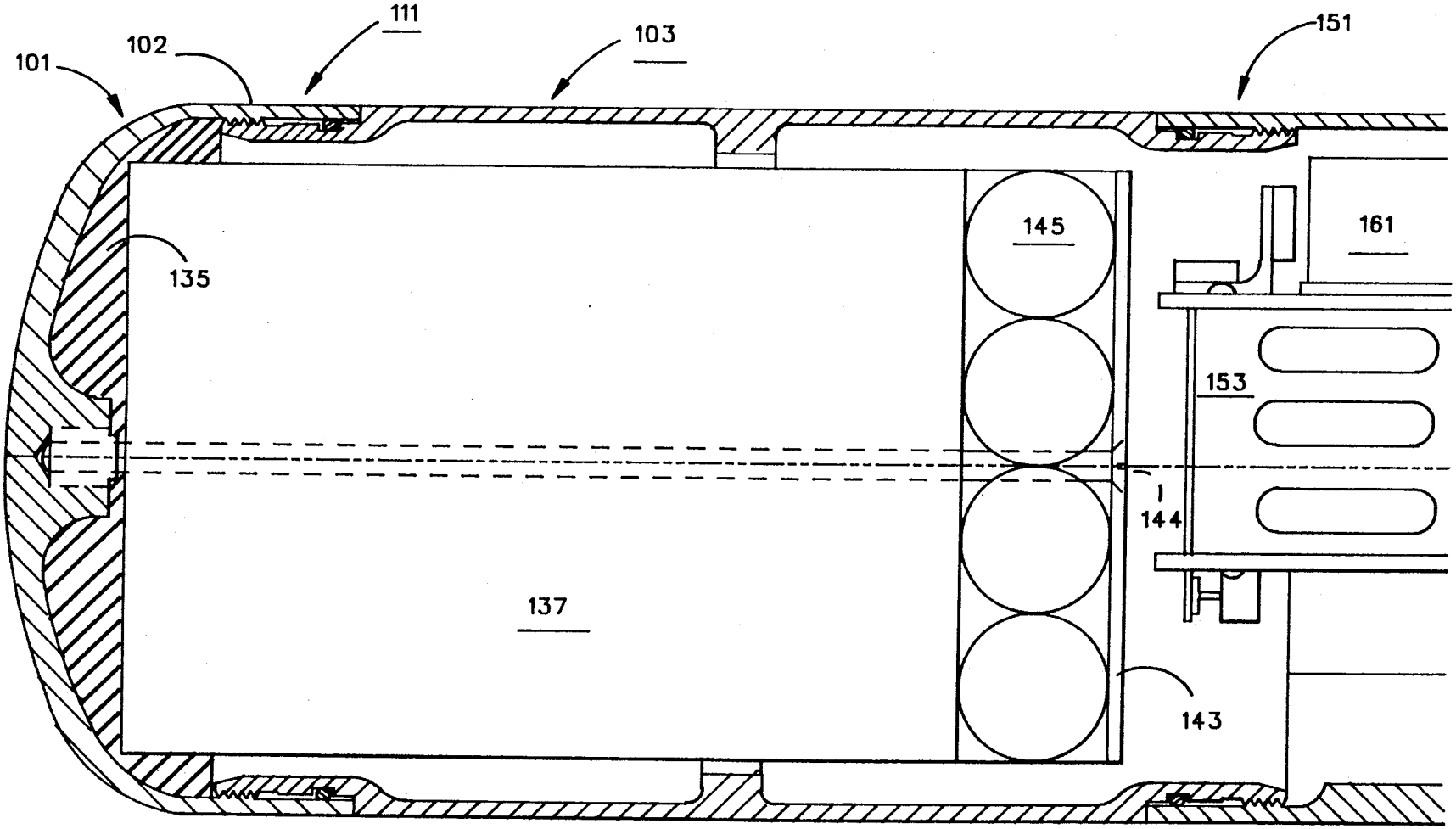
FIGS. 1*a, b,* and *c,* when assembled, illustrate a perspective overview of a torpedo type underwater device equipped with a stowable, steerable, fin assembly.
Figure 1B:
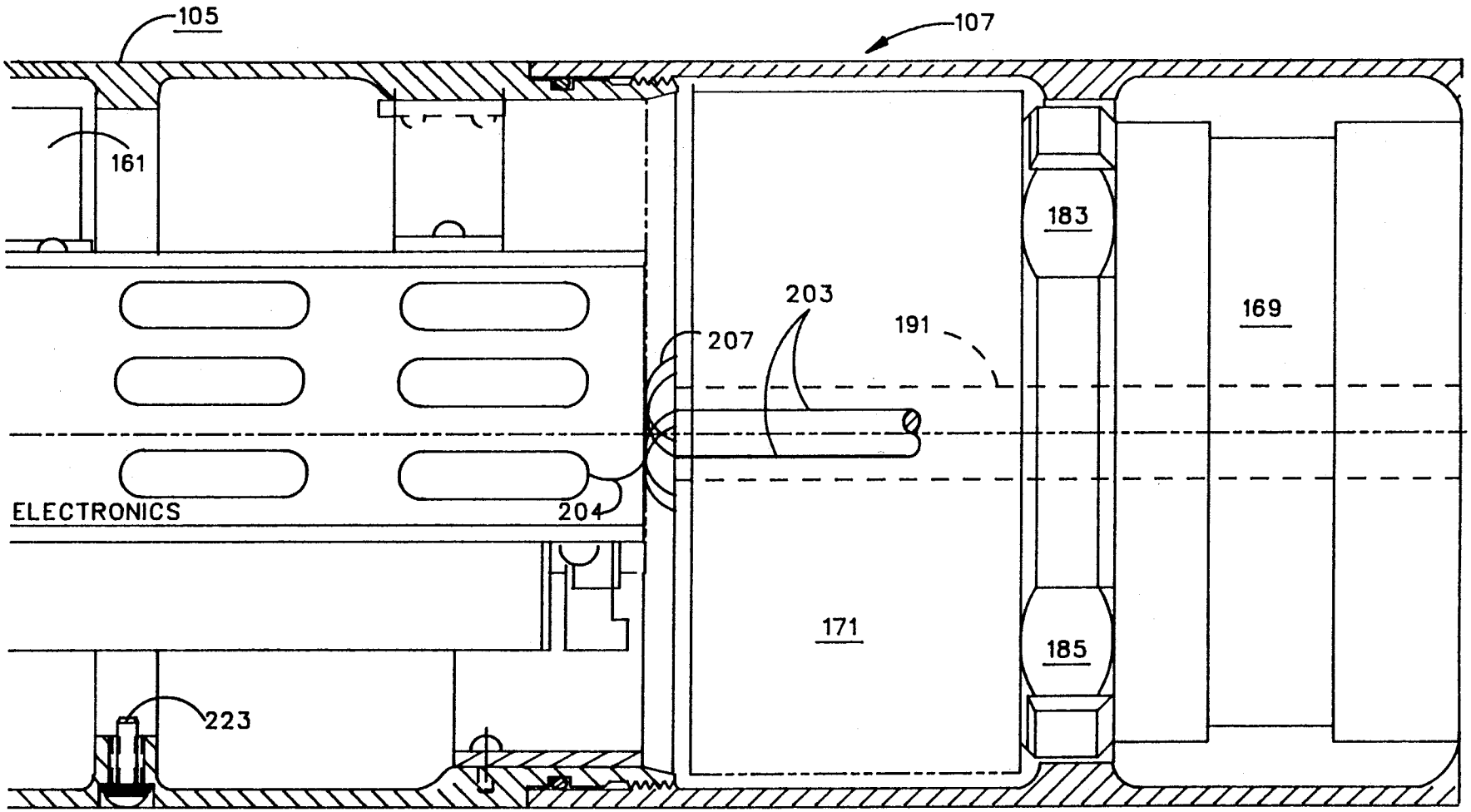
FIG. 1*d* is a cross sectional view of the underwater device of FIG. 1*a, b,* and *c;*
FIGS. 1*f* and 1*g* are views of the fastener which locks the cable array to the hull interior in watertight relation.
Figure 1C:
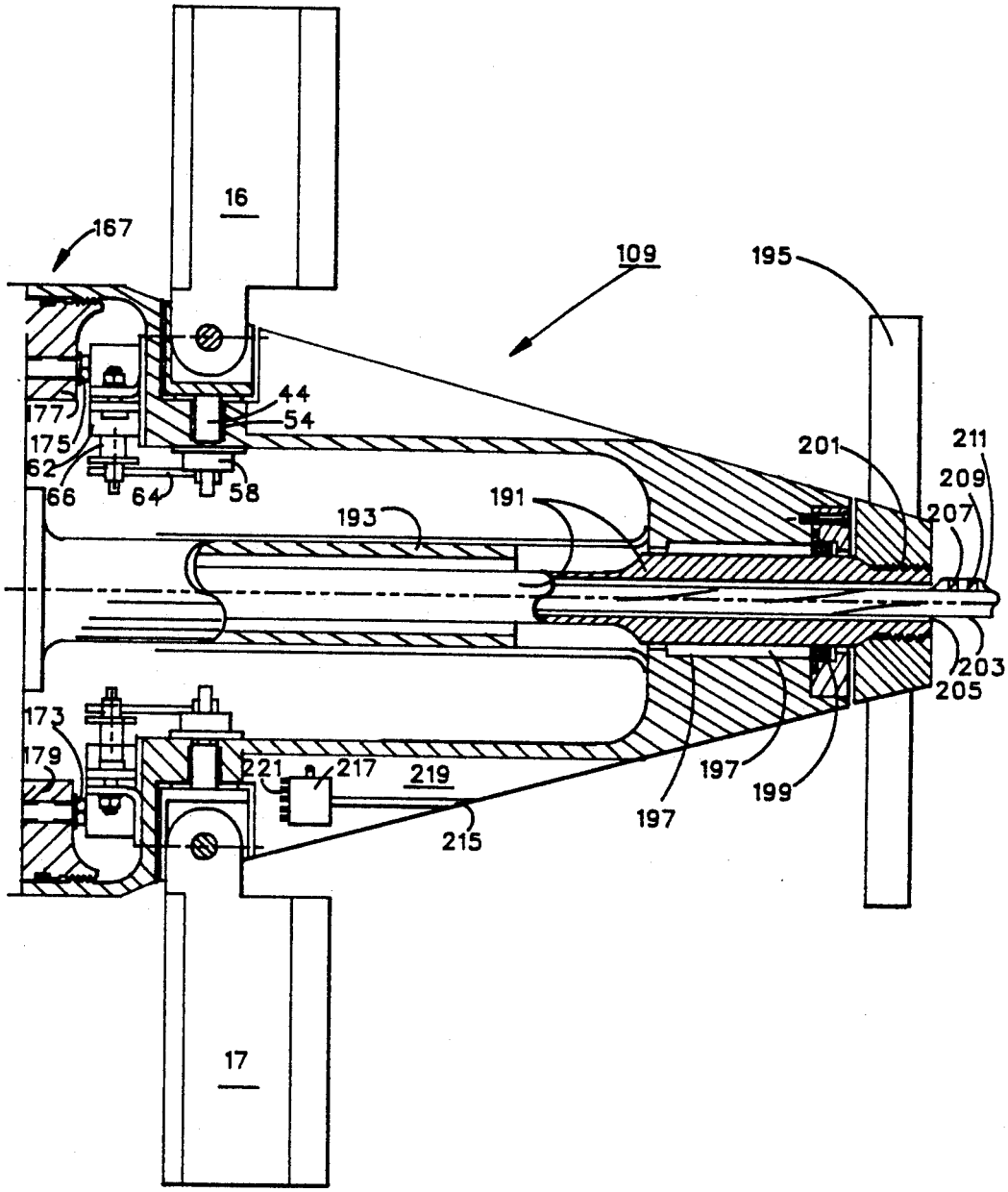
Figure 1D:
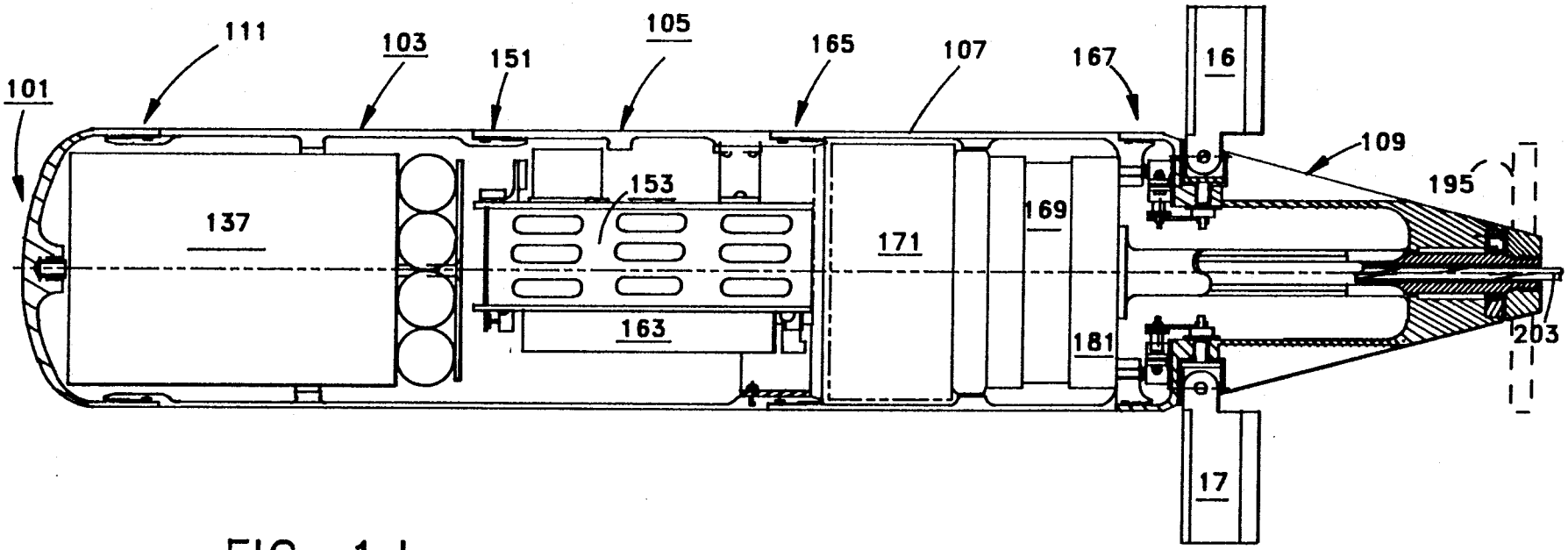

A perspective view of an underwater vehicle employing the present invention is shown in FIG. 1 with FIGS. 1*a*, 1*b*, and 1*c* showing a cross section thereof, and FIG. 1*d* being a composite of FIGS. 1*a*, 1*b*, and 1*c*. In these figures, an underwater vehicle, such as a torpedo or torpedo type underwater device 10 is shown having an exterior hull or housing 12. The exterior housing 12 is shown narrowing or tapering down toward the rearmost portion 14 of the vehicle, shown with fins deployed. This taper is typically designed to provide the minimum drag resistance during motion through the surrounding fluid, as previously discussed. The degree or use of taper is dependent upon the vehicle type and operational restrictions on speed versus applied or available thrust. An exemplary taper is about 20 degrees, measured from the vehicle centerline. The hull or housing 12 shape is used by way of example and is not meant as the only embodiment nor as a limitation on the use of the present invention.

Depending upon the type of vehicle and the manufacturing techniques employed, the hull or housing 12 can comprise the main support structure into which various components and sub-elements are mounted or represent subsections or pieces which are mounted on an internal support frame, but, the herein disclosed multi-section interlocking thread tubular configuration is preferred as having many advantages.

In either case, the housing 12 has a series of two or more (preferably four) depressions or slots 18 in which the stabilizer fins 13, 15, 16 and 17 are mounted or positioned in a stowed configuration (see FIG. 1*e*). The recessed slot or opening 18 in the housing 12 must be deep enough to substantially accommodate the width of the fin 16. Since the fin 16 is placed near the beginning of the tapered section 14, the slot 18 is actually very shallow nearest the end of the housing 12 and deeper at the beginning of the taper. The fins 16 extend substantially perpendicular to the housing 12 sides when deployed and fold to a minimum projection when stowed.

FIGS. 1*a*, 1*b*, and 1*c* plus 1*d* provide cross sectional views of the watertight torpedo underwater device hull 12. It comprises five tubular sections, identified as the forward or nose section 101 (FIG. 1*a*), battery compartment section 103 (FIG. 1*a*), computer section 105 (FIGS. 1 and 1*b*), motor section 107 and tail or fin actuator section 109 (FIG. 1*c*). The hull material is preferably aluminum, which is either painted or anodized, and the sections are preferably machined rather than cast. In this way precisely located bosses and peripheral ridges are left inside for mounting components.

Figure 6:
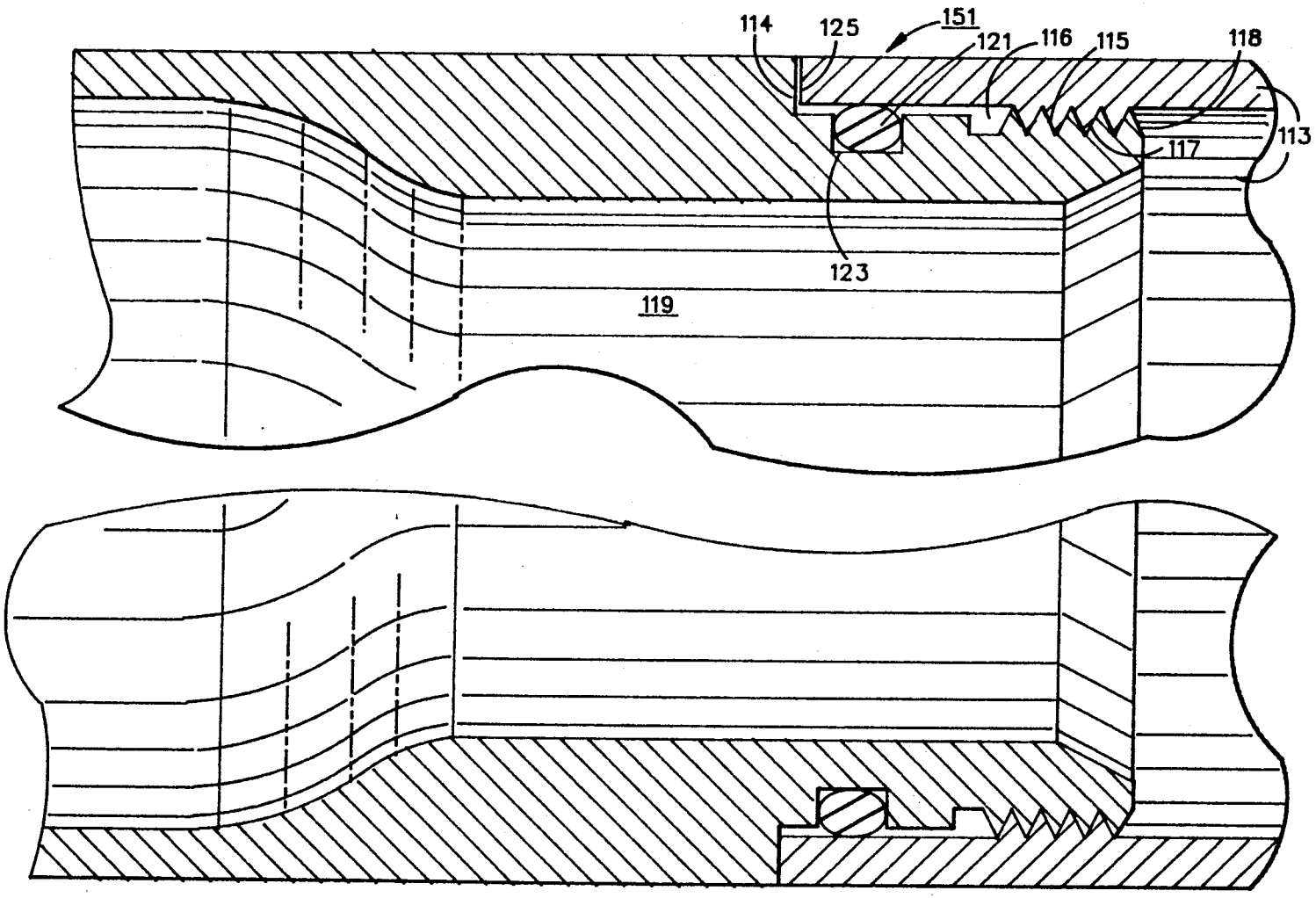
FIG. 6 is a view in cross section of a portion of hull showing a female-male joint.
Figure 6A:
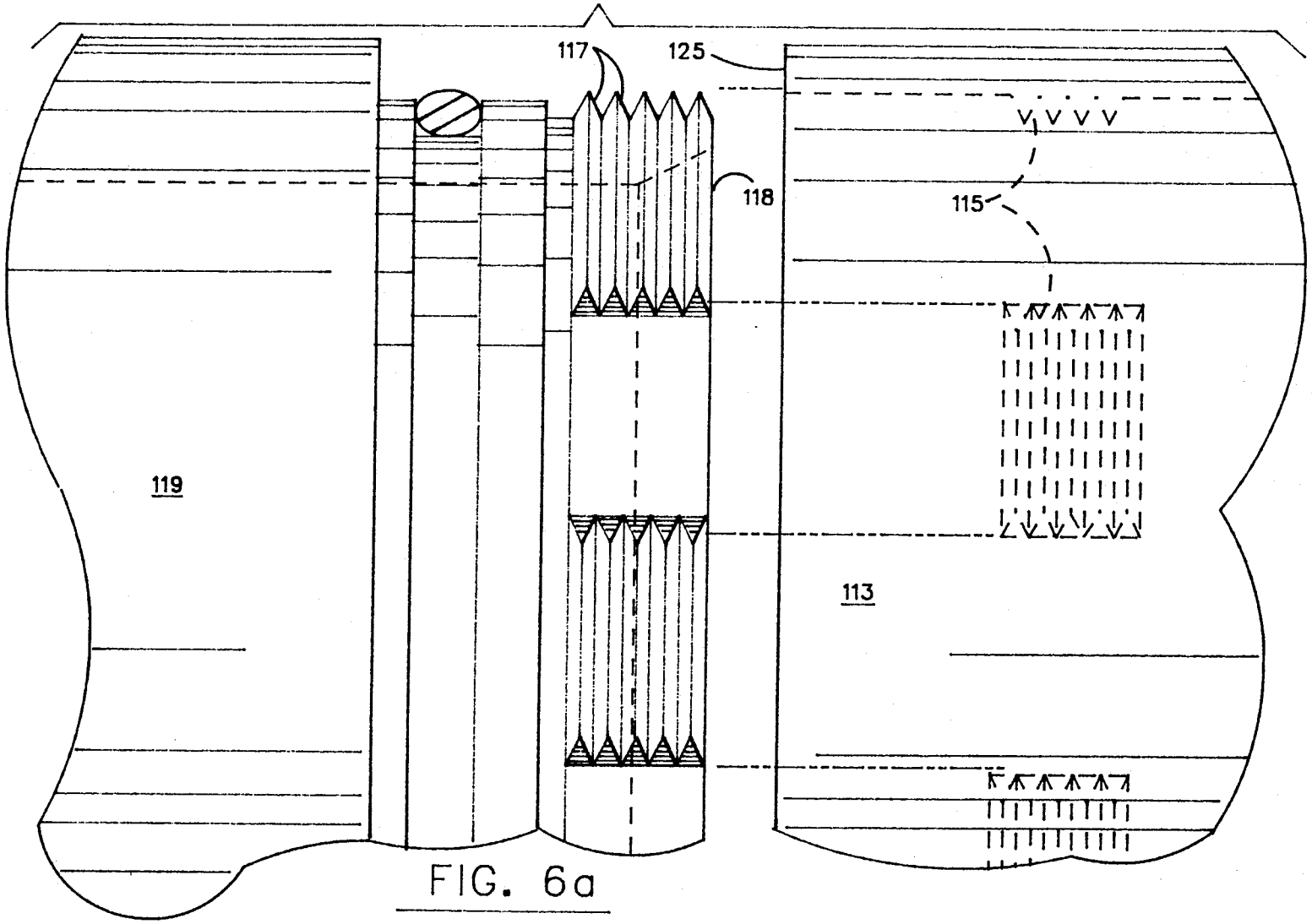
FIG. 6*a* is a view in side elevation of a portion of a hull section showing a male end for making a joint with the female end of FIG. 6, as also dotted in for FIG. 6*a;* and, FIG. 7 shows an operating circuit for the fins of the underwater device.

Details of a joint formed by two sections are best seen in FIGS. 6 and 6*a* wherein the male-female joint, such as joint 151, FIG. 1*a*, is depicted.

Female cylinder 113 (FIGS. 6 and 6*a*) has recessed internal threads 115 spaced inwardly from one end 125 to receive external threads 117 on one end 118 of male cylinder 119 (FIG. 6*a*).

Note that the threads are of the same gauge and they are both interrupted. The spaces between the threads are preferably 11½ degrees each and the interrupted threads occupy 11 degrees at each location. The drawings do not reflect these numbers as they are exaggerated for better viewing.

This construction permits the male section to be screwed into the female section using only 11 to 12 degrees of turn until the sections lock-up on peripheral edge. But, first an O-ring 121 is set in the peripheral slot 123 so that a watertight seal is assured when forward edge 125 of female section 113 tightly abuts peripheral recessed edge 114 of male section 119. Recessed region 116 adjacent threads 117 of male member 119 permits proper or overlapping of the engaged threaded portions 115–117 to insure firm engagement of peripheral edges 114–125.

This assembly thus loads the skin of hull 12, and disassembly usually requires the use of peripheral gripping spanner type wrenches.

Returning now to FIG. 1*a*, the nose section 101 comprises the female section end 102 to mate with the male battery compartments section 103, as illustrated by the watertight joint 111.

The nose section incorporates two useful components—a forward rubber pad 135 for protecting the battery bundle 137 and a threaded hole 139 for receiving battery locking screw 141 which is set in panel 143 and screws into hole 139 to clamp the battery bundle 137 and four extra batteries, e.g., 145 against the rubber cushion or pad 135.

Joint 151 reveals that battery hull section 103 is female at both ends, but, otherwise the locking and sealing principle of all of the joints is the same. i.e., all joints are male-female with an O-ring 121.

Hull section 105 (FIG. 1*b*) is provided to house computer 153 which is commercially available from Micro Link Company, Carmel, Ind. It is suspended from the hull 12 by upper and lower brackets 161. 163 attached to bosses (not shown) behind the computer in FIG. 1*b*.

Motor hull section 107 makes a female to male connection at forward joint 165 and a male to female connection at rear joint 167. The motor 169 is a dc motor operated from battery bundle 137 (see FIGS. 1*a* and 1*d*) via constant voltage variable speed motor control 171, which may be conventional. Both the motor 169 and control 171 are supported from bosses in hull section 107. Bolts 173. 175 extend from motor 169 through four boss flanges 177, 179. Further mounts 183, 185 secure both motor control 171 and motor 169.

Figure 4A:
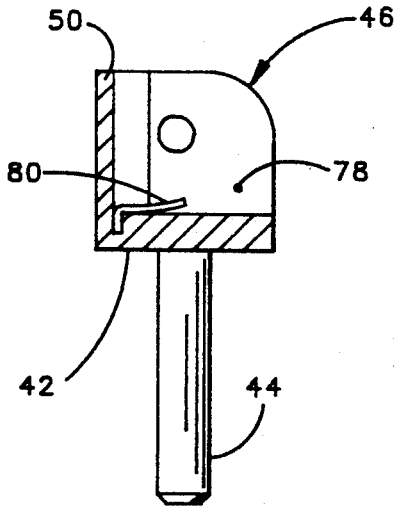
FIG. 4*a* illustrates a side plan view of a fin yoke in the assembly of FIG. 2*a;*
Figure 4C:
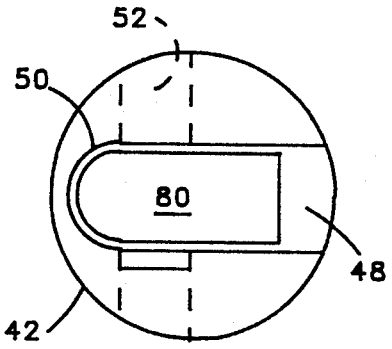
FIG. 4*c* illustrates an top plan view of the fin yoke of FIG. 4*a;*
Figure 4B:
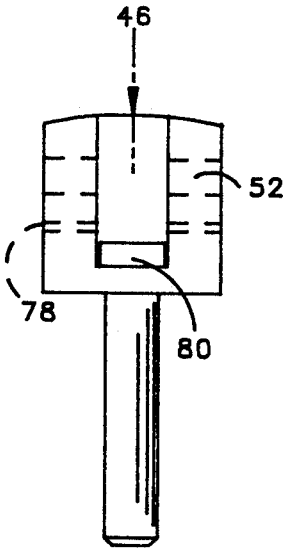
FIG. 4*b* illustrates a back plan view of the fin yoke of FIG. 4*a;*

The motor drive shaft 191 extends rearwardly through flanged sleeve 193 to receive propeller 195. The sleeve 193 protects the hollow drive shaft between or among the fin activating mechanism from, e.g., motor/solenoid 62 (FIG. 1*c*) via coupler 66 and activator rod 64 to activator shaft 58, as explained in greater detail in the description of FIGS. 2*c* and 4*a*.

All four of the fin solenoids are identical and are supported from bosses in tail section 109 at, preferably 90 degree spacing about the inner periphery. Each solenoid e.g. 62 receives fin positioning signals from computer 153, as explained in greater detail in the description of FIG. 7.

The hollow drive shaft 191 has bearings at both its front end (at motor control 171 FIG. 1*b*) and at its rear end, at bushing 197 (FIG. 1*c*) with a BAL SEAL 199 preventing leakage along the outside of shaft 191. A stationary sleeve 193 (FIG. 1*c*) protects the drive shaft 191 for the major portion of its length.

Propeller 195 is screwed onto drive shaft 191 at threads 201 (FIG. 1*c*).

Figure 1F:
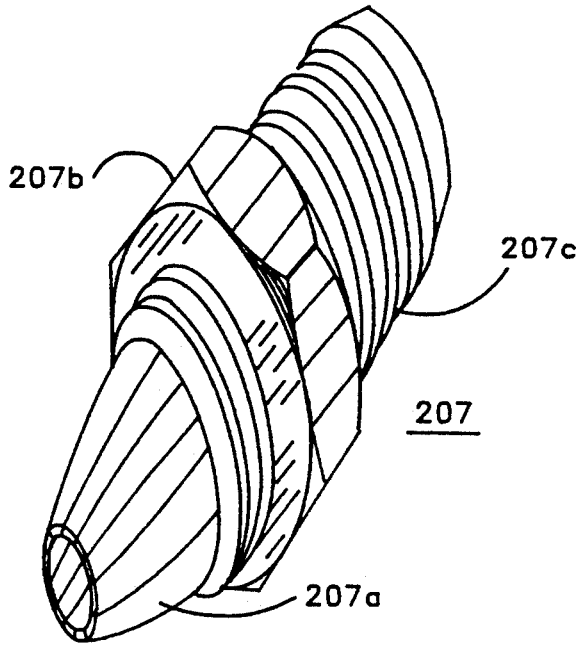
Figure 1G:
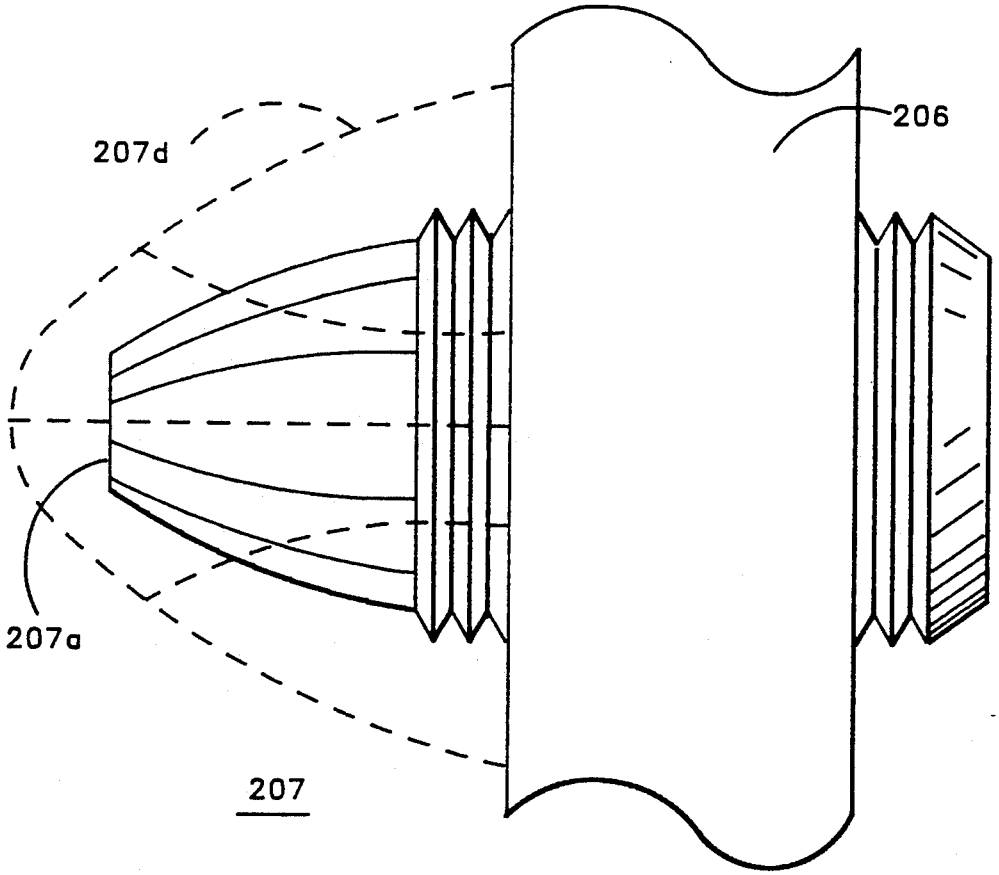

Cable array 203 extends rearwardly of the underwater device, out opening 205 in hollow drive shaft 191, and extends forwardly, through hull sections 109 and 107 and motor 169, to terminate at the forward end of motor control 171 in watertight Heyco seal 207 (FIG. 1*b*, 1*g* and 1*f*). A forwardly extending motor hub (not shown) receives the seal 207 and fixes its position adjacent computer 153 for feeding signals from the cable array 203. Such seals are available from Heyco Moulded Products Inc., Box 160, Kenilworth, N.Y. 07033.

Thus, it is seen that the hull 12 has a sea water or other liquid inlet at opening 205 (FIG. 1*c*) which surrounds the driveshaft 191 and delivers cooling to the motor 169 interior.

The cable array 203 extends up to 200 feet rearwardly of the underwater device. Cable arrays have been used before in the underwater world, and it connects to computer 153 over lead 203' (FIG. 7) for array purposes. It may carry an accessible start button 207 and a stop button 209 enclosed in a watertight jacket 211, outwardly of shroud 195 (FIGS. 1*c* and 7), particularly for test purposes. Alternatively, it may be started by an external signal.

Starting of the vehicle 10 may be initiated by depressing button 207, usually with the underwater device in the water and the array 203 unrolled or ready to be unrolled. A 30 second delay 227 (see FIG. 7) affords time to launch before the motor 169 is energized.

A second opening penetrating the hull, is shown in the tail section 109, at 215 leading to a conventional depth sensor mounted on boss 219. It has an electrical plug 221 for connection to the computer 153 to send water depth signals to the computer.

The third hull penetrating opening is filled by pressure relief screw 223, at the lower side of hull section 105 (FIG. 1*b*). It can be unscrewed to relieve either vacuum or pressure conditions in the hull 12.

Figure 2A:
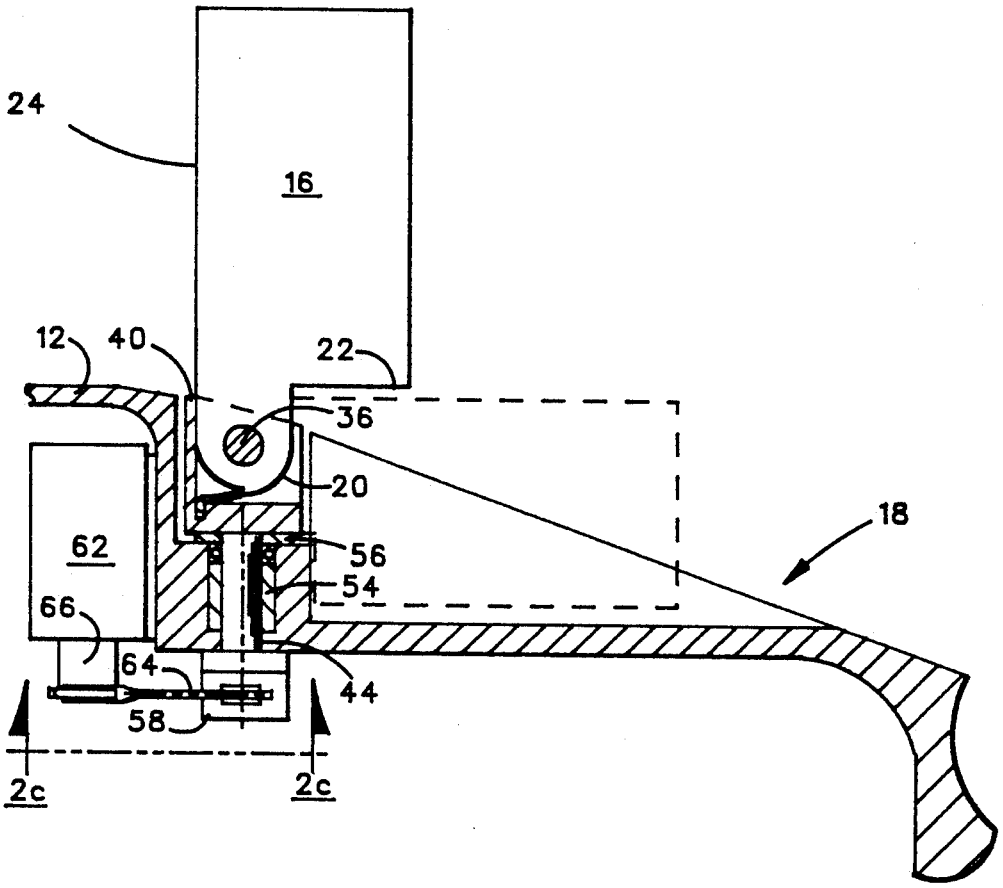
FIG. 2*a* illustrates a side plan view of a steerable stabilization fin assembly constructed according to the present invention.

Preferably, four hull openings accommodate the four fin rotation shafts, e.g., 44 (FIG. 1*c*) which are each sealed by a watertight bearing or "BAL SEAL" assembly 54 (FIG. 2*a*).

There remains only the four hull seams, shown at joints 111, 151, 165, and 167 which are force abutted and include respective O-ring seals, e.g., 121 FIG. 6.

ASSEMBLY

Before proceeding to further details of the fin apparatus, per se, the process of assembling the components into the hull sections will be described.

The forward hull section 103 is readily loaded by inserting and gluing foam pad 135 into nose 101. The battery bundle 137 and extra batteries 145 may be clamped against nose 101 by screw 141 pressing plate 143 against the batteries as it is tightened into threaded hole 139. This may be achieved before mating sections 101 and 103 by inserting the threads of one section into the spaces between the threads of the other section, and establishing relative motion between the two sections to engage the threads and tighten them to the point of achieving the abutting relationship described. The O-ring 121 is placed on the male end prior to the mating step.

Figure 7:
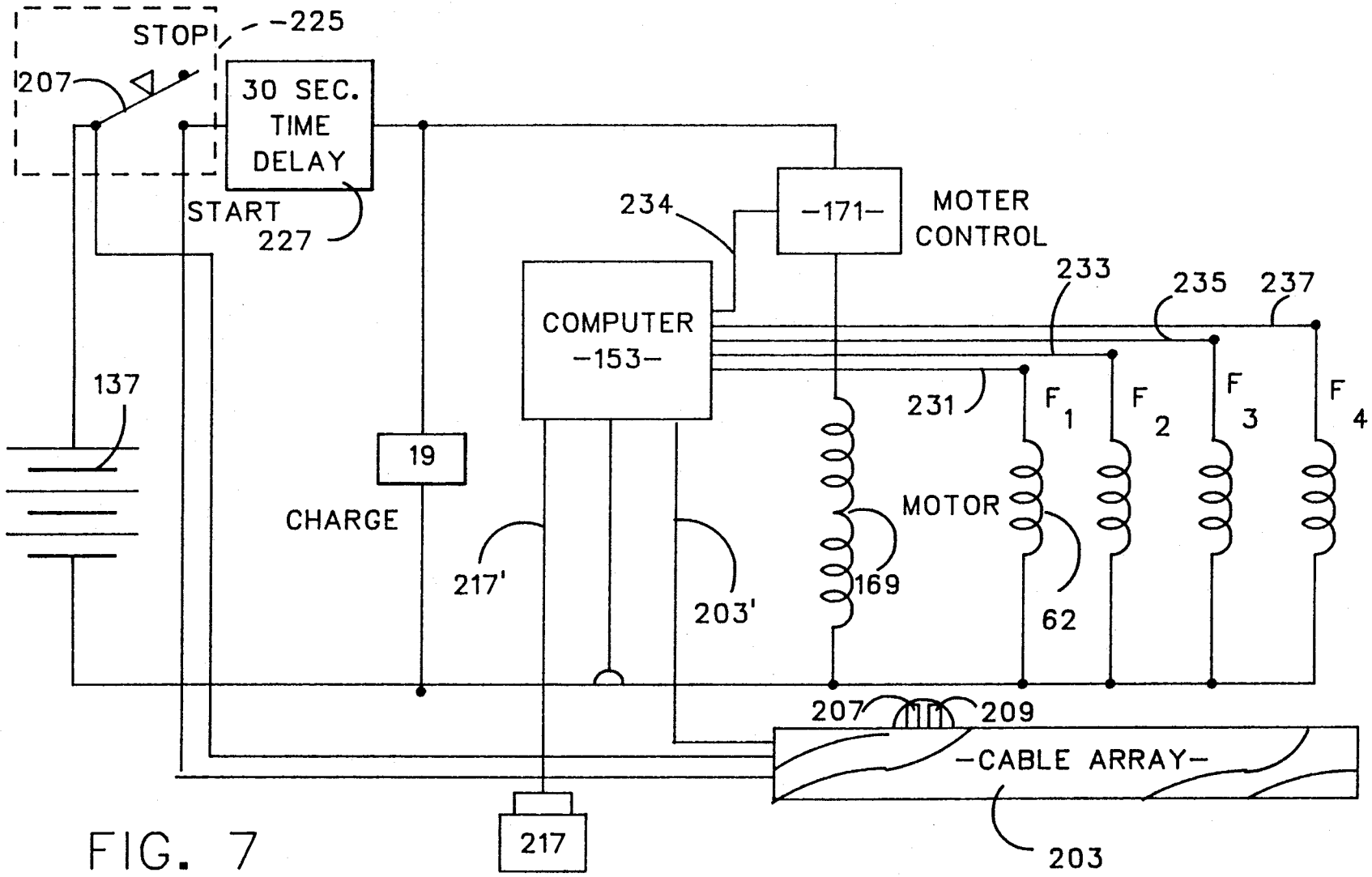

Section 105 is fitted with computer electronics 153 and is similarly attached to section 103, after the battery connections are extended to the time delay circuit 227, charge 19, motor control 171, cable array 203 and computer 153, as best seen in FIG. 7.

The motor 169 and motor control 171 are fastened into section 107, and the necessary electrical connections are made to computer 153 prior to connecting section 107 to section 105.

The various components of the fin assembly are affixed into the tail section 109, the drive shaft 191 of motor 169 is set in bearing 197, the cable array 203 has already been strung through tail section 109 and drive shaft 191 and connected to Heyco clamp 207 and electrical connection 204 made to computer 153. Forward end 207*a* of clamp 207 is longitudinally split to permit nut 207*b* to be screwed along threads 207*c*, to tighten the clamp about cable array 203 to carry the entire drag of the array and form a watertight seal with motor hub 206, through internally threaded cap 207*d* screwed on clamp threads 207*c* against nut 207*b*, thereby locking against motor hub 206.

The solenoid/motors 62 are connected to computer 153, along with depth gauge 217. Then, section 109 is mated to section 107, and the underwater device 10 is subsequently externally controlled.

Figure 2B:
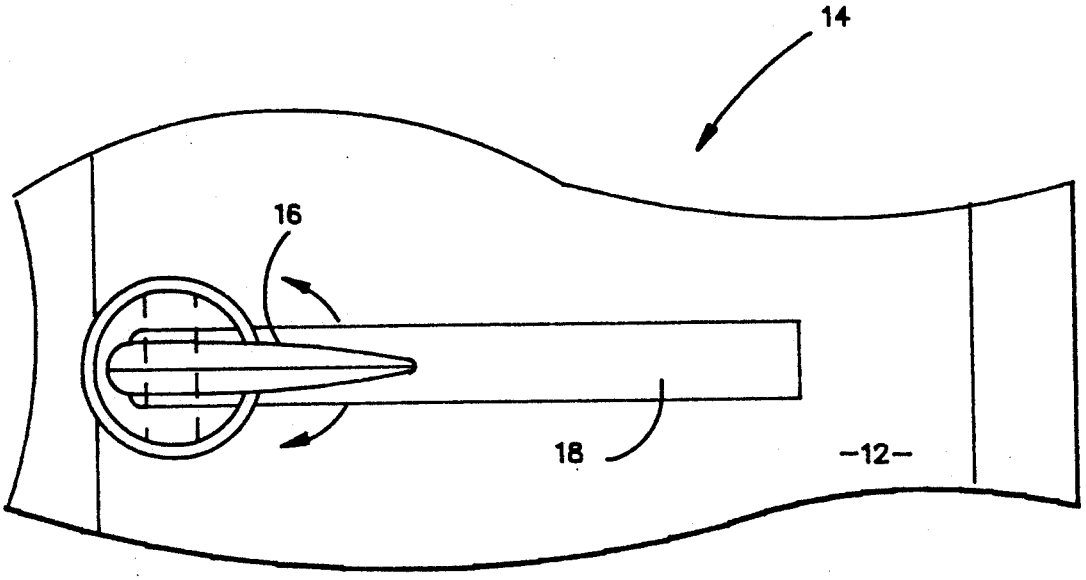
FIG. 2*b* illustrates a top plan view of the fin assembly of FIG. 2*a;*
Figure 2C:
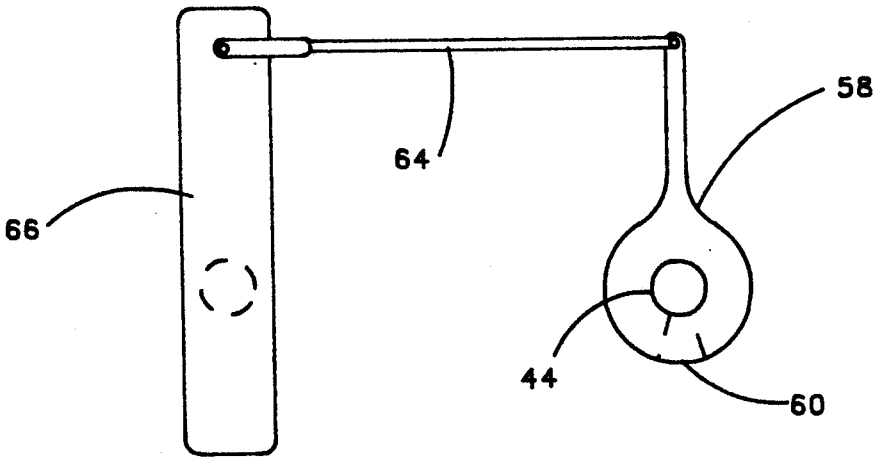
FIG. 2*c* illustrates a bottom view of the yoke and actuation assembly of FIG. 2*a;*

FIG. 2*a* illustrates a more detailed cross-sectional view of the tail portion 14, hull section 109 of the torpedo 10 with a fin 16 extending outward from the torpedo housing 12. FIG. 2*b* illustrates a top view of the same torpedo area showing the slot 18 from which the fin 16 extends. In FIG. 2*a*, the fin 16 is shown having a projection, mounting tab or stud 20 extending from a root edge 22 that runs between the leading and trailing edges 24 and 26, respectively. The mounting tab 20 preferably extends from the root edge 22 immediately next to or in line with the leading fin edge 24. This location for the tab 20 allows maximum retraction or recession of the fin 16 below the widest dimensions of the housing 12.

While other tab positions along the root edge 22 can be employed for some applications, such positions do not minimize the fin projection from the housing 12 without also requiring greater depth to the recesses 18 (above the mounting point) and also more complex support operation. That is, if the fin pivots at other than the very front edge or leading corner, then additional clearance or distance must be used between the tab mounting point and the outer torpedo, underwater device housing 12 in order to keep the fin leading edge within the outer housing boundary. When pivoting the fin around the front edge or leading corner, the leading edge is automatically recessed down to the same extent as the mounting tab pivot.

The fin 16 is configured to provide desirable directional stabilization characteristics according to well established design and manufacturing criteria. That is the span, width, and aerodynamic shape are all determined by well known factors such as the size of the vehicle to be stabilized, the average vehicle speed or forward thrust, transverse stresses, and the amount of allowable fin drag. The fin configuration may, of course, also be limited by the available stowage room.

An exemplary fin design found useful in implementing the present invention is a fin with a zero degree sweep angle. The fin is illustrated as having parallel leading and trailing edges. However, those skilled in the art will readily recognize that the technique of the present invention is suitable for other configurations including swept designs. Typically, the outermost fin edge 28 is tapered to a very thin line but may be formed as a thicker blunt or angled edge as desired. An exemplary root edge may project at an angle, such as about ten degrees, backward from the leading edge to simplify clearance for the housing 12 or for hydrodynamic design.

Fins useful for implementing the invention on a torpedo are typically made from aluminum or stainless steel to avoid the effects of corrosion from salt water. However, steel or other salt corrodible materials can be employed where the length of use is very limited or where there is little or no exposure to salt water (or other corrosive agent) or atmospheric controlled storage area. In addition, fiber composite, plastic, or ceramic materials are also useful where non-ferrous material is desired for specific applications and cost is not limiting. Depending upon the materials chosen, the fin can be manufactured by machining, stamping, or other techniques well understood in the art.

An advantage of the present invention is that longer term usage and retrieval, such as for re-use or testing, and training is now possible for torpedoes, underwater devices, and similar underwater projectiles. Therefore, less corrodible materials are preferred for the fin 16 although not required by the invention.

Figure 3A:
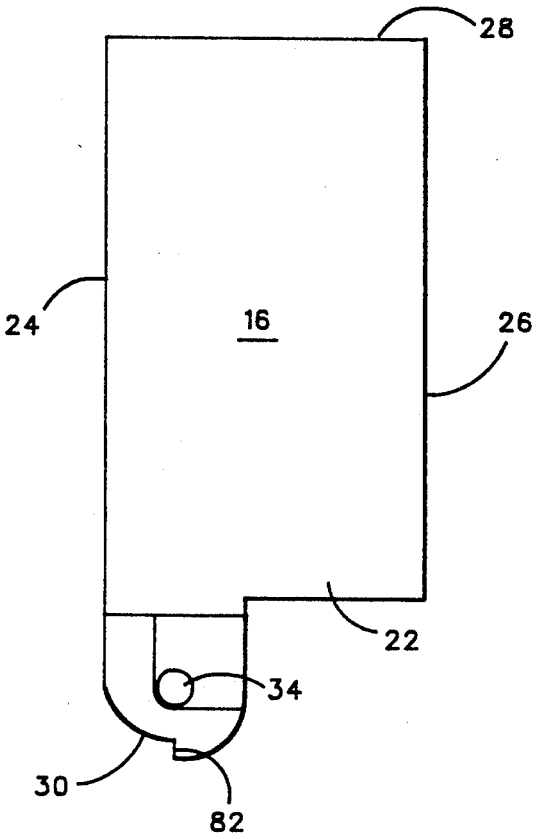
FIG. 3*a* illustrates a side view of the fin of FIG. 2*a;*
Figure 3B:
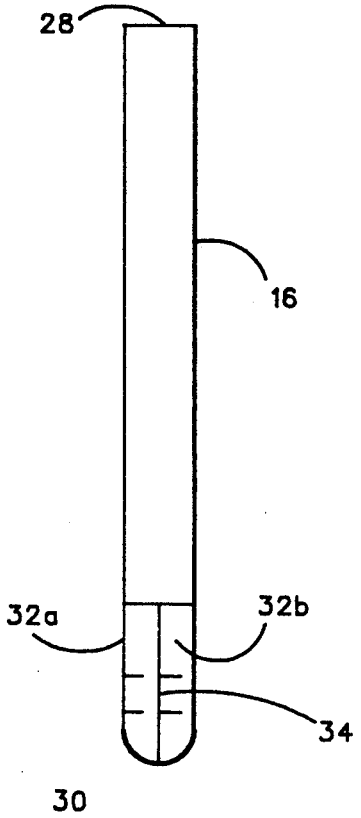
FIG. 3*b* illustrates a front view of the fin of FIG. 2*a;*

The configuration of the mounting tab 20 is illustrated in further detail in FIGS. 3*a* and 3*b*. As shown in FIG. 3*a*, the mounting tab 20 is generally formed from the same material as the fin 16. As the fin 16 is manufactured, the projection that comprises the mounting tab is formed as part of the machining, stamping, cutting, etc. used to make the fin. In the present embodiment the mounting tab 20 is essentially the same thickness as the maximum thickness of the fin or the root edge of the fin. However, depending upon the materials and forces involved, the tab can have different dimensions as long as it is manufactured thick enough to support lateral stresses to be encountered for the specific application. In addition, the tab 20 could be manufactured separately and secured, such as through welding or bonding, to the fin later. However, this latter method is not considered as efficient.

In FIG. 2*a*, the mounting tab 20 is shown extending far enough from the root edge 22 of the fin 16 to accommodate an axial passage or rotary seat 34 (FIG. 3*a*). The size of the passage 34 is dependent upon the forces to be exerted on the tab 20 and fin 16. That is, the resistance of the fluid and the stresses encountered by the fin 16 in performing vehicle maneuvering are translated to the tab 20 and must be accommodated by any axle member extending through the tab 20, as well as the tab 20 itself. Therefore, in designing the tab 20, it is made sufficiently large for the material employed to withstand predetermined stress levels encountered in a chosen application. At the same time, the axial passage 34 is made large enough to hold an axial member whose radial dimensions are also designed to handle the stresses. Exemplary dimensions for a torpedo are a tab width of about 0.62 inches with an axial passage of about 0.25 inches in diameter.

The tab 20 is shown having an arcuate or curved outer edge 30 extending away from the fin 16. While a more rectangular or even polyhedral shape could be employed for the tab edge 30, a curved surface allows the mounting tab 20 to reside closer to adjacent surfaces and provide clearance during fin rotation. Curving the surface 30 allows a more compact design for the tab 20 and adjacent support structure.

In preferred embodiments, the leading edge 30 uses shaped surfaces instead of a flat curved edge. One preferred embodiment uses beveled surfaces to make a sharply beveled surface along the leading edge 30 instead of a flat curved edge. An alternative embodiment uses a rounded or arcuate surface configuration along the edge 30. Either beveled or rounded edges 30 are useful in alignment and supportive interactions with the support yoke discussed below. FIG. 3 uses a beveled surface for illustrating the edge 30. For manufacturing purposes, the beveled portion of the edge 30 is shown extending from the fin leading edge 24 to a position parallel to the root edge 22. While the bevel shape could extend entirely around the surface 30 to the root 22, it is unnecessary since this portion of the edge does not interact with adjacent parts.

In FIG. *3b*, the mounting tab 20 is shown using substantially uniform or flat planar surfaces 32*a* and 32*b* on opposite sides of the fin. These surfaces are placed next to matching surfaces in a fin holder and will slide against such surfaces. To minimize friction while providing lateral support, these surfaces are typically made fairly flat. However, this is not strictly necessary for all applications and these surfaces can have a slight curvature if desired. In addition, a low friction washer made from materials such as polyethylene or polytetrafluoroethylene material can be used.

The cylindrical passage or hole 34 extends between the surfaces 32*a* and 32*b*, and can be manufactured using various known techniques. The passage 34 is centrally located on the mounting tab 20 and is used for holding an axle pin 36 for mounting the mounting tab 20 in place on the vehicle 10, and for rotation of the mounting tab 20, and fin 16, about a longitudinal axis extending through the passage 34.

Returning to FIG. *2a*, the fin 16 is mounted on the vehicle 10 by securing the mounting tab 20 into a support yoke 40. The construction of the yoke 40 is shown in further detail in FIGS. *4a* through *4c*. As shown in FIG. *4a*, and *2b*, the support yoke 40 uses a generally cylindrical main body 42 which is attached to a support post 44. It is not strictly necessary for the yoke 40 to be cylindrical but this minimizes the clearance and volume required for the yoke 40.

As shown in FIGS. *4b* and *4c*, the yoke 40 is shaped as a split or forked structure having a central passage or channel 46 for holding the fin tab 20. The channel 46 is formed as a groove in the main yoke body 42 which extends across the main body 42 starting at an outer edge 48. For maximum strength and fin alignment, the channel 46 does not completely bisect the main yoke body 42, but leaves some of the yoke in place as a channel end wall 50. However, the channel could extend completely across the yoke body 42 where desired.

The yoke channel sidewalls, and end wall 50, are manufactured thick enough to support lateral stresses to be encountered for the specific application. An exemplary dimension for a steel yoke would be a main body of about 0.75–0.8 inches in diameter with a 0.25–0.31 inch wide channel 46 and a main body extension height of about 1.125 inches.

As seen in FIGS. *4b* and *4c*, the yoke channel sidewalls have cylindrical passage or openings 52 formed in them for insertion of the axle pin 36 from the mounting tab 20. The axial pin or rod member 36 is inserted into the passages 52 and through the matching or matting axle passage 34 in the tab 20. The rod or post 36, again comprises material such as stainless steel which withstands the designed for stresses and potential corrosion. The rod 36 can be secured in place using a press fit design, with or without a bonding agent or fluting, or otherwise secured in place using a set pin, screw, or welding, either to the yoke or to the fin. That is, the pin 36 can be designed to be fixed in the tab 20 and rotate in the passages 52, or fixed in the passages 52 and rotate freely in the passage 34.

In preferred embodiments, the bottom and back wall of the yoke channel 46 are grooved, curved, or beveled to match the outer edge of the mounting tab 20. In the preferred embodiment of FIG. *4c*, the bottom and back wall of the yoke channel 46 are beveled to match the outer edge of the beveled mounting tab 20. An exemplary bevel angle is about 45 degrees, although other angles, and arcs, can be used. The beveled surfaces provide a more precise alignment of the fin base in the yoke 40 and surface contact when the fin is deflected sideways so as to relieve some of the stress from the axial pin 36, and increase the integrity of the fin and yoke interface. The beveled edge 30 also makes a reasonable intermediate structure in the manufacture of the normally rounded leading edge 24. Alternatively, a rounded edge can be formed by extending the leading edge configuration.

Returning again to FIG. *2a*, the yoke support post or shaft 44 is inserted through a passage in the housing 12 and held or secured in place with the aid of a "BAL SEAL" assembly 54 which provides a lightweight fluid tight seal on both sides of a joint with the post. In order to reduce friction, one or more washers 56 are placed around the post 44 on the inside and outside, under the yoke 40, of the housing 12. These washers are typically made from material such as polytetrafluoroethylene.

The yoke 40 can have a post 44 of arbitrary length, limited only by the available room inside the housing 12 and a specific application. The length of the post 44 depends on application specific design features known to those skilled in the art. The support post 44, and rod or pin 36, should also be polished to assure easy movement or a high slip rate.

The lower end of the post 44 is connected to an attitude or fin angle control mechanism within the housing 12. In general, fin control is provided by an actuator shaft 58, or gear and shaft assembly, which provides rotary motion for the post 44 about its central, longitudinal, axis. As seen in FIG. *2c*, the actuator shaft 58 is attached to the yoke post 44 using a press fit or elements such as a set screw or pin 60. The actuation is typically powered by the electric motor or solenoid 62 positioned within the housing hull 12, through the additional actuator rod 64 and solenoid coupler 66. An advantage of the present invention is that the solenoid 62 can be very small and require a minimal power source, such as a battery.

The fin 16 is deployed or erected in place by one of various elements. In the illustrated embodiment, the fin 16 is deployed using the force of a spring 70. The spring 70 used to deploy or erect the fin 16 is typically made from a tempered spring steel material. This provides a very strong and powerful spring which assures deployment of the fin. As before, corrosion is generally not a consideration for most applications. However, where corrosion is a concern, other materials such as a coated steel or brass, etc. could be used. The number of turns and diameter dimensions may need to be adjusted among the various materials as would be obvious to those skilled in the art, to obtain the same deployment force.

An important feature of the invention is the provision of common structure for effecting both pivot and rotary motion to the fin 16. Yoke 40 includes a first axis pin 36 for allowing the fin 16 to be rotated or pivoted between stowed and operative positions while its support shaft portion 44 provides a second axis perpendicular to the first axis to permit fin rotation or at least partial rotation for steering.

Figure 5A:
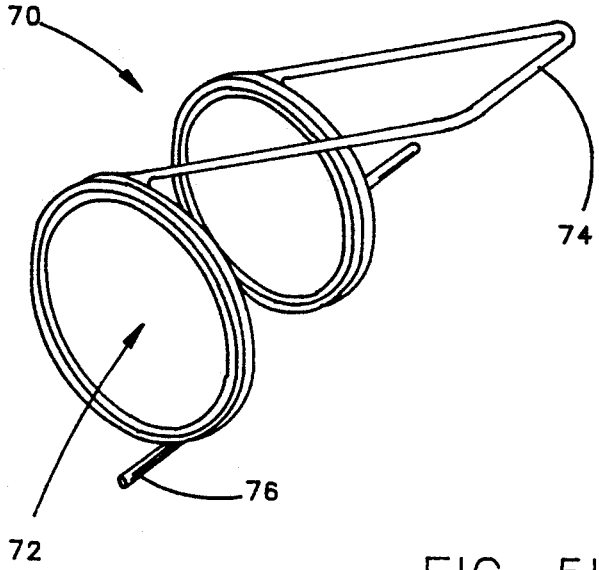
FIG. 5*a* illustrates a perspective view of an actuation spring found in the fin assembly of FIG. 2*a;*
Figure 5B:
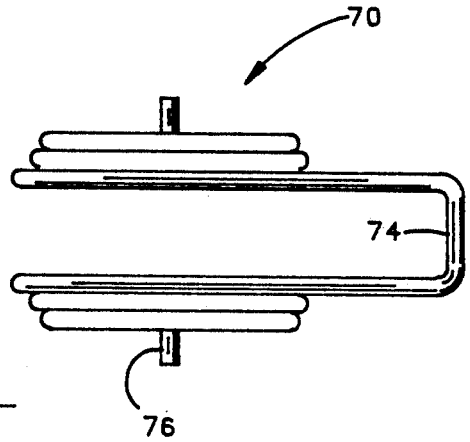
FIG. 5*b* illustrates a top view of the spring of FIG. 5*a;*
Figure 5C:
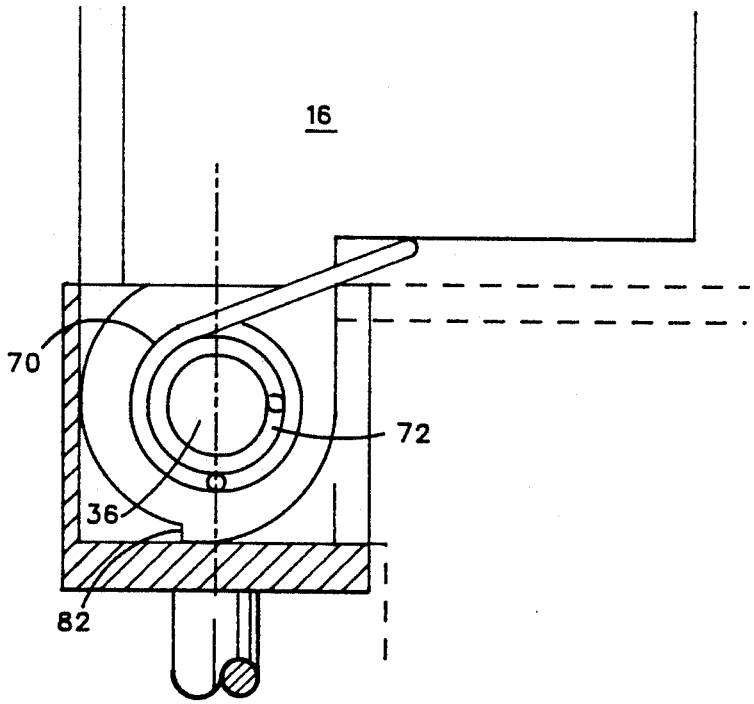
FIG. 5*c* illustrates a detailed side view of the spring of FIG. 5*a* installed in the fin assembly of FIG. 2*a.*

As shown in FIGS. 5*a* through 5*c*, the spring 70 comprises multiple turns about a central opening 72 which has a diameter sufficiently large to clear the pin 36. A preferred structure is to form the spring 70 as a pair of multiple turn loops which are joined together by a straight sided loop 74 which is used to press against the base of the fin 16 near the tab 20, along root edge 22. The spring 70 loops terminate on the other end with one or more straight mounting tabs or projections 76 which are used to engage the yoke 40. In the preferred embodiment, the projections 76 engage a pair of holes 78 in the side of the yoke channel 46. It is easy to manufacture the holes 78 as a single passage drilled from one side through the entire yoke 40 body 42. When the holes 78 extend completely through the material of the yoke 40, a small pin or tool can be used to disengage the spring 70 tabs where desired.

In the preferred embodiment of FIG. 2*a*, the fin 16 is retained in a deployed position, at least in part, using a small leaf spring 80. The spring 80 is typically made slightly wider than the tab 20, or fin 16, so that a tool inserted between the tab 20 and channel 46 sidewalls can press the spring out of the way for fin retraction. However, this is not necessary for all applications of the fin 16. The leaf spring 80 engages a slot or ridge 82 on the curved edge 30 of the tab 20 to prevent counter rotation of the tab 20, and the fin 16, about the axle pin 36 once the fin is deployed to a predetermined position. The engagement end of the spring 80 can be flat, angled, curved, or have a curved bump, as desired, for engaging the tab 20.

Alternatively, the fin can be secured in place prior to deployment using a small pin or clip along the trailing edge which is subsequently withdrawn upon actuation of the torpedo. Since this type of actuation represents an increased risk of mechanical failure, another method is a spring or spring actuated plunger which presses sideways on the tab 20 or fin 16 into a depression to retain the fin in place during initial handling and installation. At the same time, the spring can also be used to interact with a second depression to help secure the fin 16 in a deployed position.

In the preferred alternative, the stainless steel ring 11 with fracturable securing bolt 19, can be used for fin retention prior to deployment which is automatically destroyed or fractured during launching of the device. This can include a small netting or flap which presents extreme drag on the retention device and, therefore, aids in removal upon encountering the water. Such a retention device is also easily replaced if it breaks during handling, or for manual actuation of the fins for inspection prior to installation of the torpedo, such as where the torpedo was stored for a period of time.

OPERATION

In FIG. 7, dc circuitry is depicted for operating the fins in or out of the water.

The sole power source is the battery bundle 137 which may comprise a large plurality of long life D cells, or the like. Greater power sources would be employed with larger underwater devices The start switch 207 is shown in dotted square 225, but it is in reality located in cable array 203 at a location rearwardly of the underwater device, as shown in FIG. 1*c*. Once this switch is closed, time delay 227 counts off 30 seconds and connects the battery bundle 137 to explosive charge 19 and to the rest of the circuit including computer 153. The fins are deployed by spring(s) 70 (FIG. 5*c*), and they assume their normal positions (i.e.) perpendicular to the device hull 12 in 0° elevation and 0° rudder, due to voltages from computer 153 over leads 231, 233, 235 and 237 to solenoids, e.g., 62 respectively for each of fins 16, 17, 13 and 15, driving them to home position, if not already there.

The computer 153 may also control the speed of motor 169 by way of lead 234 to the motor speed control 171, and receives the depth of the underwater device over lead 217' from depth sensor 217.

The computer 153 may store several selectable programs for predetermining the course of the underwater device (i.e.) away from the mother ship or launch station in any direction, at level depth, undulating depths, down and up or encircling.

For example, the underwater device 10 may be made to dive down, and to the right, by placing positive signals on rudder fins 16 and 17 (FIGS. 1*c*, 1*e*), and simultaneously negative signals on elevator fins 13 and 15. After a predetermined time or a random time, all signals are returned to zero with all fins may be returned to home position, or simply left where they are for new computer instructions.

Alternatively, the device 10 can be returned close to launch position by applying corresponding negative signals to the rudder fins 16, 17 and positive signals to elevator fins 13, 15 which signals are equal and opposite to the previous "dive to the right" signals.

A further alternative dive uses a conventional comparator function in computer 153 to compare the depth reached by the device 10, as indicated by on-board depthometer 217 signals sent to the computer over lead 217' (FIG. 7) with a predetermined depth recorded in computer 153.

In this fashion, device 10 may be caused to follow a given course at a preselected depth.

Underwater device 10 may be caused to surface without turning right or left by signals applied to elevator fins 13 and 15, or it may be returned to its original launch location by turning it around using rudder fins 16, 17, and then reversing the signals previously described.

Preplanned trips or courses may be followed by the device 10 when it is performing surveying, messenger, or delivery services. If it is used as a decoy, prerecorded signals may be used, or the computer 153 may perform a random generator function to supply such signals for fin control, thereby effecting erratic movement of the device through the water.

While the type of signals illustrated can be generated by the computer, they can also be made available from signal generators or magnetic tape readers, separate tapes being available for separate trips at very small cost. Any convenient guidance and control device may be used in the hull 12. Many devices are well known in the art. This includes, but is not limited to, accelerometer input devices, inertial measurement units, gyroscopes (ring laser, gyrocompass, etc.), magnetic compasses homing devices (radar, laser, sonar, etc.), computers programmed for artificial intelligence or otherwise, and the like.

The new stabilization fin design provides a very flexible apparatus that can be mounted on a vehicle, such as a torpedo at any location a hole for the yoke support post can be made. Provided proper clearance exists for the fin in the stowed position. The new fin design allows a single system to automatically accommodate changes in vehicle dynamics including changes in vehicle length, weight, etc.

The foregoing description of preferred embodiments has been presented for purposes of illustration and description. It is not intended to be exhaustive nor to limit the invention to the precise forms disclosed, and many modifications and variations are possible in light of the above teaching. The embodiments were chosen and described to best explain the principles of the invention and its practical application to thereby enable others skilled in the art to best utilize the invention in various embodiments and with various modifications as are suited to the particular use contemplated. It is intended that the scope of the invention be defined by the claims and their equivalents.

What is claimed is:

1. A self propelled underwater vehicle comprising, in combination:

a hull of generally tubular configuration and having a substantially conical shaped rear portion;

said hull comprising a plurality of hollow interlocking tubular sections with one section including said rear portion;

adjacent tubular hull sections including peripherally spaced apart threaded portions respectively disposed internally and externally thereof for mating relationship upon relative circumferential motion of the adjacent sections;

said adjacent sections further configured to provide an abutting joint when fully mated;

watertight sealing means between the mated sections;

a plurality of steerable stabilization fins mounted on said hull about said rear conical portion at spaced apart locations;

hull slots for receiving the respective fins when stowed;

means for pivoting the fins out of said slots to extend generally perpendicular from said hull;

means for respectively at least partially rotating each fin to steer said vehicle;

means for controlling said means for rotating;

motor means; and, propulsion means on said rear portion operated by said motor means.

2. The vehicle of claim 1, wherein:

said motor means comprises motor control means and a motor responsive to said motor control means;

said means for controlling said means for rotating comprising computer means; and, said motor being controlled by said computer means via said motor control means.

3. The vehicle of claim 2, further comprising:

a cable array connected internally of said hull and extending rearwardly through the rear portion to be towed;

a source of energy in said hull; and, circuit means connecting the source of energy to the computer means and the motor means.

4. The vehicle of claim 3, further comprising:

time delay means connected in said circuit means to delay flow of energy from said source of energy to the computer means and the motor means for a predetermined time interval.

5. The vehicle of claim 4, further comprising a restraining strap for holding said fins in stowed position, an explosive bolt carried by said strap for fracturing said restraining strap when energized; and, an electrical connection from the explosive bolt to said circuit means to energize said explosive bolt after said predetermined time interval.

6. The vehicle of claim 5, further comprising:

locking means carried by the hull for locking said fins in operative position when pivoted out of said slots.

7. The vehicle of claim 3, wherein:

said cable array is electrically connected to said computer means and physically connected forward of said motor; and, a hollow drive shaft extending through said motor to house the forward portion of said cable array and to drive the propulsion means.

8. The vehicle of claim 1, wherein:

each fin has a predetermined configuration having a root edge extending between fin leading and trailing edges;

a mounting tab formed along said root edge;

said means for rotating comprising a support yoke rotatably secured to said vehicle adjacent to an outer hull surface having a first central axis about which it rotates extending substantially perpendicular to said outer surface;

said means for pivoting comprising rotation means connected between said support yoke and said mounting tab for rotatably joining said tab to said yoke and for allowing rotation of said tab about a second axis which extends substantially perpendicular to said first axis; and, said means for pivoting deploying said fin about said second axis so as to move between a preselected stowed position adjacent said outer surface to an erected position extending outward from said outer surface.

9. The fin assembly of claim 8 wherein said support yoke comprises a main body having a channel extending inward from one side starting with an open end adjacent the one side of said main body and terminating with a closed end, said channel being sufficiently wide for insertion of said support tab.

10. The fin assembly of claim 9 wherein said tab comprises a projection with a curved edge extending outward from said root edge having two opposing substantially parallel planar surfaces, and a centrally located axial passage extending between the two opposing planar surfaces.

11. The fin assembly of claim 10 wherein said tab is located adjacent said leading edge.

12. The fin assembly of claim 11 wherein said pivoting means comprises a first cylindrical pin extending through said axial passage and beyond the planar surfaces and into matching cylindrical passages in sidewalls of said channel.

13. The fin assembly of claim 12 wherein said pivoting means comprises a coiled spring assembly secured about said pin of a deployment.

14. The fin assembly of claim 12 wherein said channel closed end and bottom wall comprise beveled surfaces extending between said sidewalls; and, said tab curved edge is formed as a beveled surface having a bevel angel substantially the same as said channel front wall and bottom.

15. The fin assembly of claim 12 wherein said channel closed end and bottom wall comprise rounded surfaces extending between said sidewalls; and, said tab curved edge is formed as a rounded surface having an arc substantially the same as said channel front wall and bottom.

16. The fin assembly of claim 9 further comprising pivot means connected to said support yoke for selectively rotating said yoke about said first axis.

17. The fin assembly of claim 14 wherein said pivot means comprises a support post formed on a lower portion of said main body and extending along said first axis into said housing.

18. The fin assembly of claim 8 wherein said pivoting means comprises a coiled spring assembly secured between said tab and support yoke.

19. The fin assembly of claim 8 further comprising retention means for engaging said tab and securing said fin in a stowed position unit deployment is desired.

20. The fin assembly of claim 8 further comprising retention means for engaging said tab and securing said fin in a deployed position.

21. The fin assembly of claim 8 wherein said fin configuration comprises parallel leading and trailing edges with root and tip edges extending in between and said fin having a sweep angle of zero degrees.

22. A self propelled underwater vehicle comprising, in combination:

a hull of generally tubular configuration and having a substantially conical shaped rear portion;

said hull comprising a plurality of hollow interlocking tubular sections with one section including said rear portion;

each pair of adjacent tubular hull sections including peripherally spaced apart threaded portions respectively disposed internally and externally thereof for mating relationship upon relative circumferential motion of the adjacent sections, one end of each section of said pair being a male end and the corresponding end of the other section being a female end;

said adjacent sections further configured to provide an abutting joint when fully mated, said joint comprising the outer edge of the female end and a peripheral flange recessed from the outer edge of the male end;

watertight sealing means between the mated sections supported by the female end and enclosed by the male end;

a plurality of steerable stabilization fins mounted on said hull about said rear conical portion at spaced apart locations;

hull slots for at least partly receiving the respective fins when stowed;

means for pivoting the fins out of said slots to extend generally perpendicular from said hull;

means for respectively at least partially rotating each fin to steer said vehicle;

means for controlling said means for rotating;

motor means operated by the means for controlling; and, propulsion means on said rear portion operated by said motor means.

23. The vehicle of claim 22, wherein:

the means for controlling the means for rotating and the motor means is a computer means; and, the motor means comprises a motor and a motor control.

24. The vehicle of claim 23, further comprising:

a source of energy in the hull;

circuit means connecting the source of energy to the computer means and to the motor via the motor control means.

25. The vehicle of claim 24, further comprising:

a cable array connected to the vehicle and adapted to be towed thereby.

26. The vehicle of claim 25, further comprising:

a start and stop switch connected in said circuit means between the source of energy and the computer and motor control means.

27. The vehicle of claim 26 further comprising:

a hollow drive shaft extending through the motor to the rear of the hull, and also forward of the motor to provide a housing for the forward portion of the cable array;

the forward end of the cable array being secured in the motor; and, watertight sealing means about the cable array at the forward end of the drive shaft to permit water to enter the drive shaft for cooling purposes without flooding the hull.

28. The vehicle of claim 24 further comprising:

electrical time delay means connected in said circuit means to preclude energy from the computer and motor control means for a predetermined period of time.

29. The vehicle of claim 22, wherein:

said means for pivoting the fins comprises a yoke carried by the hull and having an axle pin penetrating a fin to permit the fin to be moved from a stowed position at least partly in a hull slot to an operative position substantially perpendicular to the hull;

said yoke having a support shaft penetrating the hull; watertight bearing means about the support shaft to permit rotation of the shaft and yoke to rotate the fin;

the means for at least partially rotating a fin comprising electrical coil means and mechanical turning structure connected between the electrical coil means and said support shaft to rotate the shaft, yoke, and any attached fin in response to electrical signals received by said electrical coil means.

30. The vehicle of claim 22, wherein:

said means for pivoting and said means for rotating fins comprise a common mechanical structure;

said structure comprising a yoke carried by the hull and having an axle for receiving a fin for rotation from a slot to an operating position extending outwardly of the hull;

said hull having an aperture in each fin region;

a bearing in each aperture;

said yoke having a shaft penetrating the hull via said bearing in watertight sealing relation to the hull and bearing;

said means for means for controlling comprising an electrical coil for establishing rotary motion; and, said means for rotating further comprising linkage means for transferring said rotary motion to said shaft.

31. A steerable stabilization fin assembly for use on underwater vehicles comprising;

a fin of predetermined configuration in contact with the water and having a root edge extending between fin leading and trailing edges;

a mounting tab formed along said root edge;

a support yoke rotatably secured to said vehicle adjacent to an outer surface having a first central axis about which it rotates extending substantially perpendicular to said outer surface;

rotation means connected between said support yoke and said mounting tab for rotatably joining said tab to said yoke and for allowing rotation of said tab about a second axis which extends substantially perpendicular to said first axis; and, deployment means for rotating said fin about said second axis so as to move between a preselected stowed position adjacent said outer surface to an erected position extending outward from said outer surface.

32. The fin assembly of claim 31 wherein said support yoke comprises a main body having a channel extending inward from one side starting with an open end adjacent the one side of said main body and terminating with a closed end, said channel being sufficiently wide for insertion of said support tab.

33. The fin assembly of claim 32 wherein said tab comprises a projection with a curved edge extending outward from said root edge having two opposing substantially parallel planar surfaces, and a centrally located axial passage extending between the two opposing planar surfaces.

34. The fin assembly of claim 33 wherein said tab is located adjacent said leading edge.

35. The fin assembly of claim 33 wherein said rotation means comprises a first cylindrical pin extending through said axial passage and beyond the planar surfaces and into matching cylindrical passages in sidewalls of said channel.

36. The fin assembly of claim 35 wherein said deployment means comprises a coiled spring assembly secured about said pin.

37. The fin assembly of claim 35 wherein said channel closed end and bottom wall comprise bevel surfaces extending between said sidewalls; and, said tab curved edge is formed as a beveled surface having a bevel angel substantially the same as said channel front wall and bottom.

38. The fin assembly of claim 35 wherein said channel closed end and bottom wall comprise rounded surfaces extending between said sidewalls; and, said tab curved edge is formed as a rounded surface having an arc substantially the same as said channel front wall and bottom.

39. The fin assembly of claim 32 further comprises pivot means connected to said support yoke for selectively rotating said yoke about said first axis.

40. The fin assembly of claim 37 wherein said pivot means comprises a support post formed on a lower portion of said main body and extending along said first axis into said housing.

41. The fin assembly of claim 31 wherein said deployment means comprises a coil spring assembly secured between said tab and support yoke.

42. The fin assembly of claim 31 further comprising retention means for engaging said tab and securing said fin in a stowed position unit deployment is desired.

43. The fin assembly of claim 31 further comprising retention means for engaging said tab and securing said fin in a deployed position.

44. The fin assembly of claim 31 wherein said fin configuration comprises parallel leading and trailing edges with root and tip edges extending in between, said fin having a sweep angle of zero degrees, a span of about three inches, and a width of about one and one-half inches.

* * * * *